US005493090A

United States Patent [19]

Vestner et al.

[11] Patent Number: 5,493,090

[45] Date of Patent: Feb. 20, 1996

[54] TWO-STEP OPERATING MECHANISM FOR COMBINED INTERRUPTER DISCONNECT SWITCH

[75] Inventors: Markus Vestner, Buesingen, Switzerland; Tomas Otterberg, Murrysville, Pa.

[73] Assignee: ABB Power T&D Company, Inc., Blue Bell, Pa.

[21] Appl. No.: 223,162

[22] Filed: Apr. 5, 1994

[51] Int. Cl.[6] ..... H01H 33/42

[52] U.S. Cl. ..... 218/7; 218/67; 218/84; 218/12; 218/14

[58] Field of Search ..... 200/48 R, 144 B, 200/146 R, 146 A, 148 R, 148 A, 148 F, 150 G, 48 R–48 CB; 218/1, 2, 7, 12, 14, 43, 45, 57, 67, 78, 80, 84

[56] References Cited

U.S. PATENT DOCUMENTS

| | | | |
|---|---|---|---|
| 3,674,956 | 7/1972 | Erni | 200/148 A |
| 3,875,355 | 4/1975 | Frink et al. | 200/48 A |
| 4,110,579 | 8/1978 | Frink et al. | 200/146 R |
| 4,752,859 | 6/1988 | Chabala et al. | 361/602 |
| 4,983,792 | 1/1991 | Rogers et al. | 200/148 F |
| 5,091,616 | 2/1992 | Ramos et al. | 200/146 R |

FOREIGN PATENT DOCUMENTS

| | | | |
|---|---|---|---|
| 1156141 | 5/1964 | Germany | H01H 33/12 |
| 1028719 | 5/1966 | United Kingdom | H01H 3/30 |

*Primary Examiner*—J. R. Scott

*Attorney, Agent, or Firm*—Woodcock Washburn Kurtz Mackiewicz & Norris

[57] ABSTRACT

An operating mechanism for a combined interrupter and disconnect switch comprises an operating crank and an interrupter support housing which are separately rotatable about a common pivotal axis. The interrupter switch is part of a disconnect switch arm and is secured to the support housing. The interrupter contacts are operated by a linearly movable rod which has an end connected to a lever extending from the operating crank and is movable thereby. A crank arm connected to said operating crank is connected to and moved by a linearly movable operating shaft. A spring-biased latch lever is pivotally mounted to the interrupter support housing and releasably engages the free end of the crank arm lever so that the housing rotates with the crank for a first portion of the rotation of the crank and closes the disconnect switch. When the disconnect switch closes, the latch releases and the crank rotates relative to the housing to operate the linearly movable rod which operates the interrupter switch.

10 Claims, 6 Drawing Sheets

TWO-STEP OPERATING MECHANISM FOR COMBINED INTERRUPTER DISCONNECT SWITCH

RELATED APPLICATIONS

This application is related to application Ser. No. 07/990,010, filed Dec. 14, 1992, now abandoned in the names of Stroud and Otterberg, and is assigned to the assignee of the present invention.

BACKGROUND OF THE INVENTION

This invention relates to disconnect switches with interruption capacity, and more specifically relates to a two-step operating mechanism for opening a circuit interrupter in a first range of its motion and for opening a disconnect gap in a second range of motion and for reversing that operation during closing.

A novel disconnect switch with interruption capacity is described in copending application Ser. No. 07/990,010, identified above. This switch incorporates an elongated interrupter switch directly in the movable blade or arm of a disconnect switch. During the opening operation, the interrupter is first opened, and the disconnect blade arm is then rotated to an open disconnect blade position. During closing, the disconnect blade is first rotated to its closed gap position, and the interrupter is subsequently closed. The novel combination of the interrupter in the disconnect switch arm results in a substantial saving of space in a switch yard, as compared to installations in which the interrupter and disconnect switch are separate and distinct units which are connected in series.

In order to operate the disconnect blade and interrupter, two separate operating mechanisms are ordinarily required. The present invention provides a novel, simple linkage and operating mechanism for the combined disconnector and interrupter.

BRIEF DESCRIPTION OF THE INVENTION

The present invention provides a novel operating mechanism for a combined disconnect switch and circuit interrupter in which the continued movement of a single operating linkage causes the rotation of the disconnect blade over a first range of rotation of a crank and the linear movement of the interrupter operating mechanism during a second range of rotation of the crank.

In carrying out the invention, the rotatable disconnect arm (sometimes called a disconnect blade) is fixed to a housing which is rotatable relative to a stationary support. A crank is rotatably mounted coaxially with the rotatable housing, and is connected to the housing through a spring-biased latch which is released when the disconnect arm reaches its closed position. After the latch releases, the continued movement of the crank linearly moves the interrupter operating rod relative to the now stationary and closed disconnect arm to close the interrupter contacts.

To open the switch, the crank is rotated in an opposite direction, to move the interrupter rod to open the interrupter contacts after a first range of rotation of the crank. The crank then engages an internal stop within the rotatable housing. Continued rotation of the crank resets the latch and also rotates the housing so that the disconnect arm rotates to its open position.

Thus, the novel mechanism of the invention is simple in operation and is easily maintained, while accomplishing a complex series of movements.

Other features and advantages of the present invention will become apparent from the following description of the invention which refers to the accompanying drawings.

DETAILED DESCRIPTION OF THE INVENTION

Figure 1:
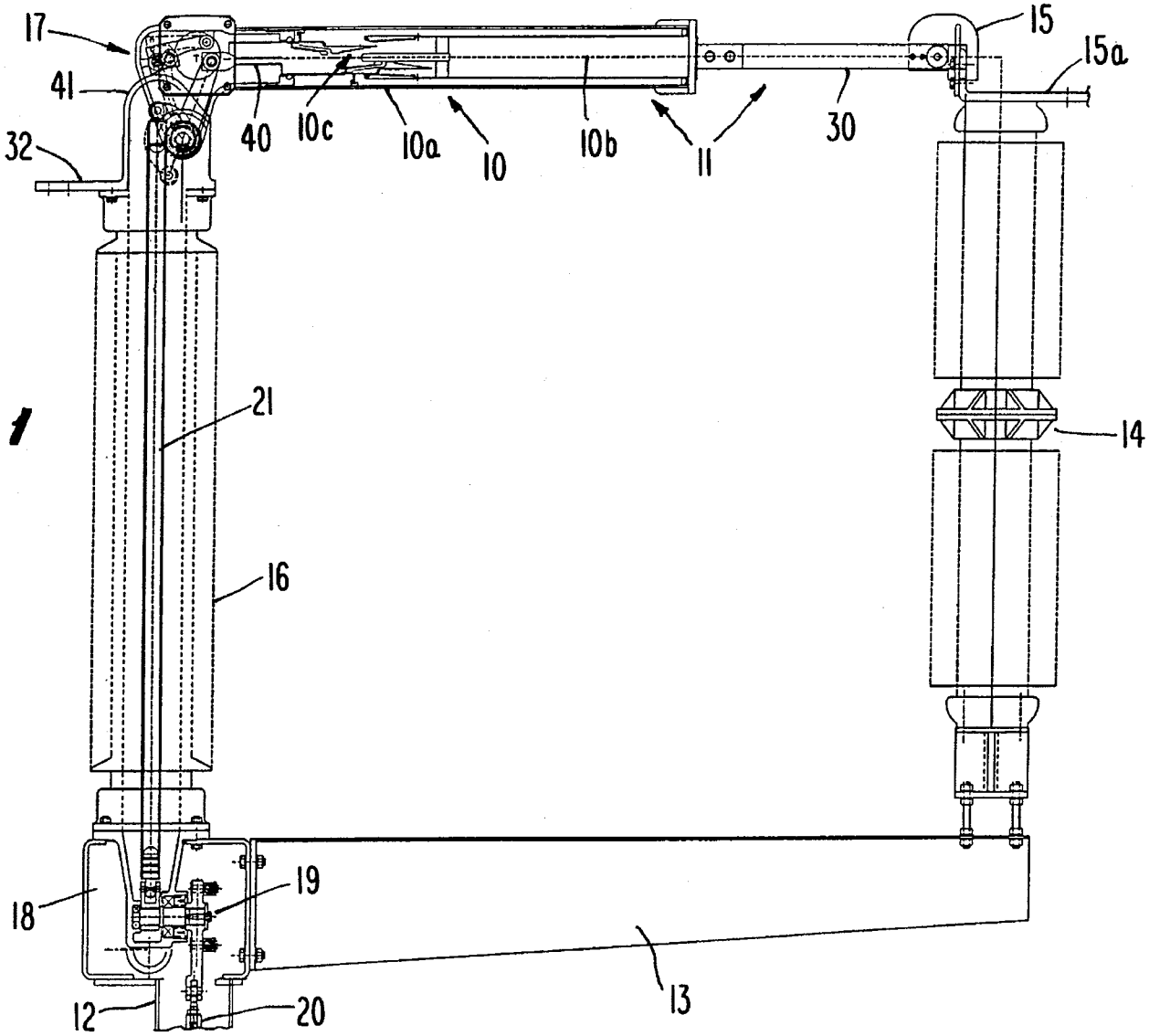
FIG. 1 is an elevation view of a closed combined interrupter switch and disconnect switch which uses the operating mechanism of the invention; the interrupter switch is shown in the open position in top half above the axial center line thereof and in the closed position in the bottom half below the axial center line thereof.
Figure 2:
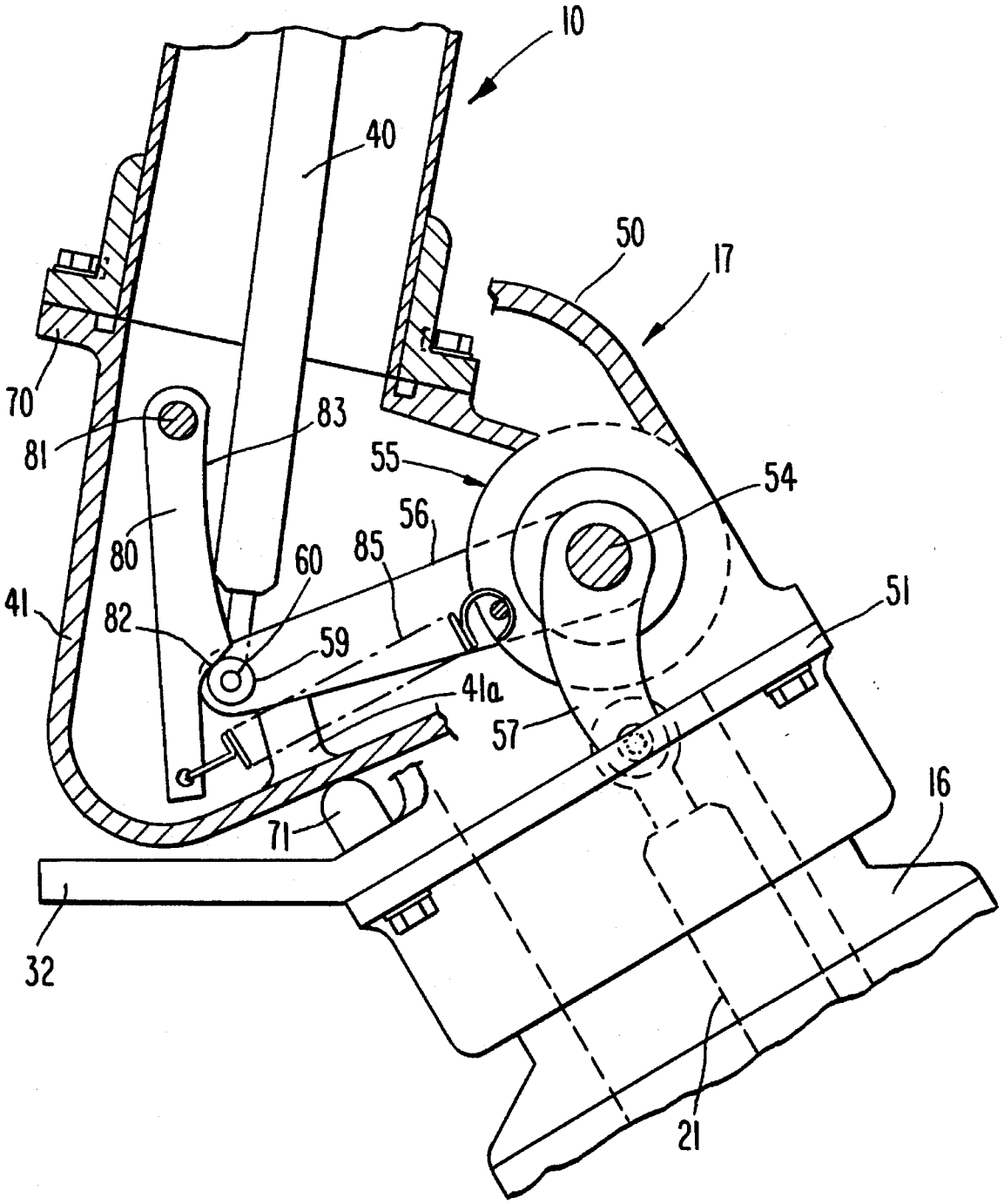
FIG. 2 is a partial cross-sectional view of the novel two-step operating mechanism of this invention with both the disconnector and interrupter open.
Figure 3:
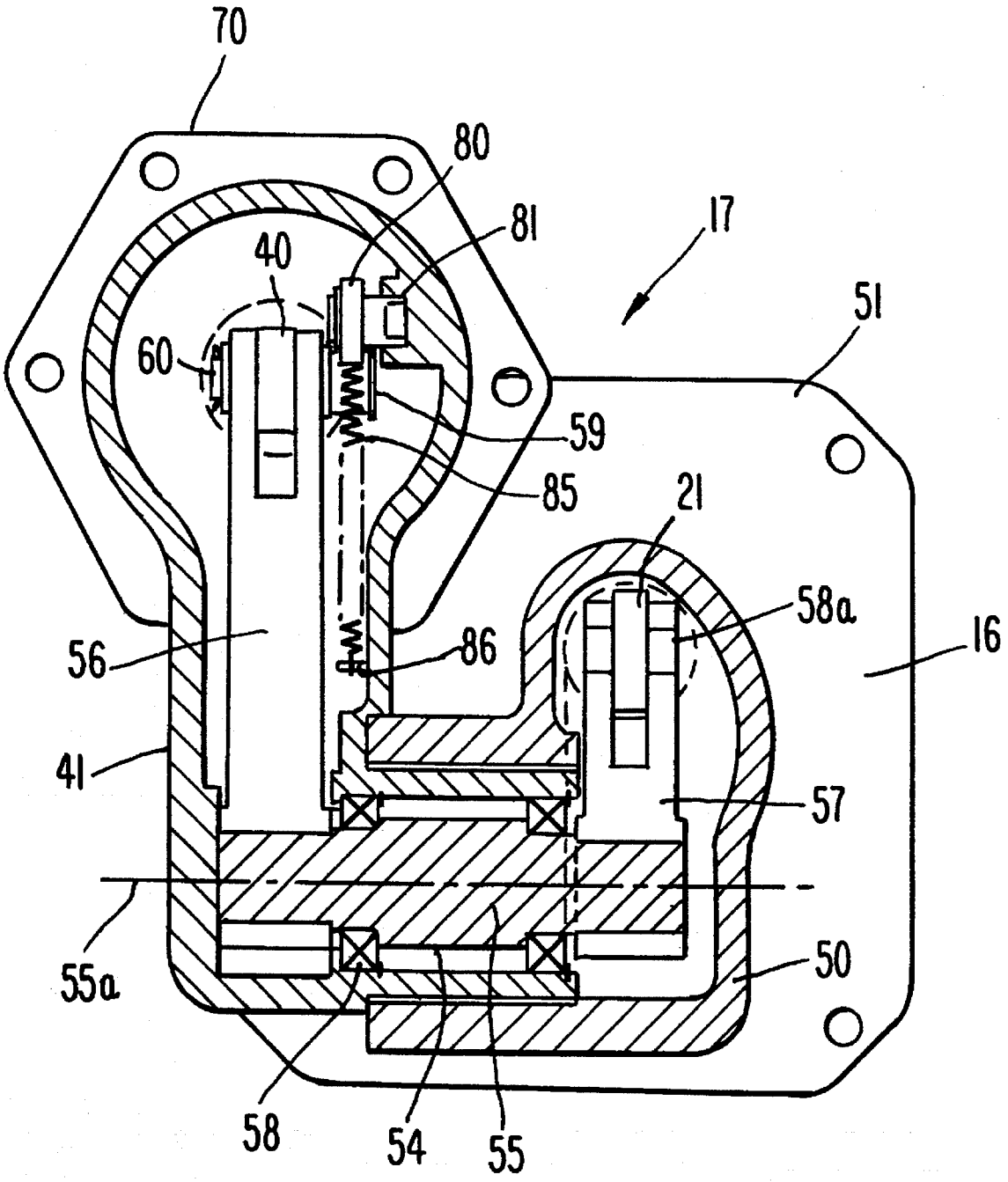
FIG. 3 is a top view of FIG. 2 in partial cross-section.

Referring first to FIGS. 1 and 2, there is shown a combined interrupter 10 and disconnector 11 made in accordance with the description of copending application Ser. No. 07/990,010, the disclosure of which is incorporated herein by reference. The assembly is supported above the ground by a suitable schematically shown support column 12 which has a support arm 13 extending therefrom. Support arm 13 carries a first insulator stack 14 which is terminated by a stationary jaw contact assembly 15 at its upper end. A first switch terminal 15*a* extends from the jaw contact assembly. Arm 13 also carries a second insulator 16 which carries operating mechanism linkage 17 and the disconnector 11 and interrupter 10 at its upper end.

The lower end of insulator 16 is mounted atop a housing 18, which may be a casting, and which contains a crank 19 for transmitting the linear, or other motion of operating rod 20, operated from the ground, to a linear (an axially directed) motion for operating rod 21 which extends through insulator 16 to the mechanism 17.

Figure 1A:
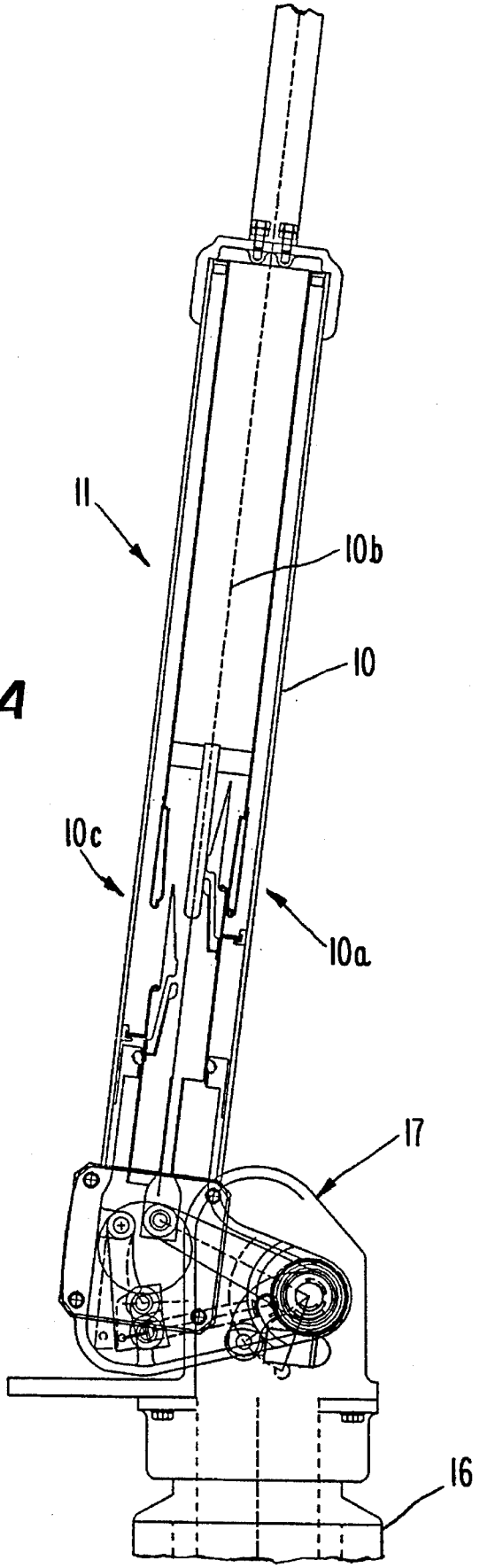
FIG. 1A shows the disconnector of FIG. 1 in the open position.

The general operation of the system of FIGS. 1 and 2 is as follows:

When the assembly is closed, as in FIG. 1, the blade contact portion 30 of disconnector 11 engages the jaw contact 15 and the contacts within interrupter 10 are closed as depicted generally in FIG. 1 and FIG. 1A at 10*a* in the bottom half below the axial center line 10*b* thereof. The switch is then closed between terminals 32 and 15A. In order to open the switch combination, operating rod 20 is moved in a direction to move operating rod 21 down. The mechanism 17, which will be later described in detail, first moves the interrupter operating rod 40 to the left to open the interrupter contacts of interrupter 10 as depicted generally in FIG. 1 and FIG. 1A at 10*c* in the top half above the axial center line 10*b* and initially open the circuit between terminals 32 and 15A. The continued motion of rod 21 then causes the housing 41 carrying interrupter 10 and disconnector 11 to rotate to an open gap position, shown in FIG. 1A.

To reclose the switch assembly, rod 21 is moved upwardly. The mechanism 17 translates this motion into the initial rotation of disconnnector 11 to the closed position of FIG. 1 with blade 30 engaging jaw contact 15, which stops the motion of blade 30. Mechanism 17 then causes the subsequent closing of the contacts of interrupter 10.

The novel operating linkage of mechanism 17 is best shown in FIGS. 2 through 5. Referring to FIGS. 2 through 5, assembly 17 has a stationary conductive housing 50, which may be a casting, having a bolt flange 51 for connecting it to the top of insulator 16 in FIG. 1. Terminal 32 extends from housing 50. A crank 55, consisting of an axle or rotatable pivot shaft 54, a lever arm 56 and a crank arm 57 is rotatably mounted within housing 50 by bearings 58 (FIG. 3) and is rotatable relative to housing 50. A roller 59 is carried on the end of lever arm 56. Conductive housing 41 is also rotatably mounted around bearing 58 and within housing 50. Thus, housing 41 and crank 55 are independently rotatable about a common axis 55*a* in FIG. 3.

The insulating pull rod 21 extends within the housing 50 and is pivotally connected to the end of crank arm 57, as by pin 58*a*. The outer end of lever arm 56 is pivotally connected to interrupter operating rod 40, as by pin 60.

Figure 4:
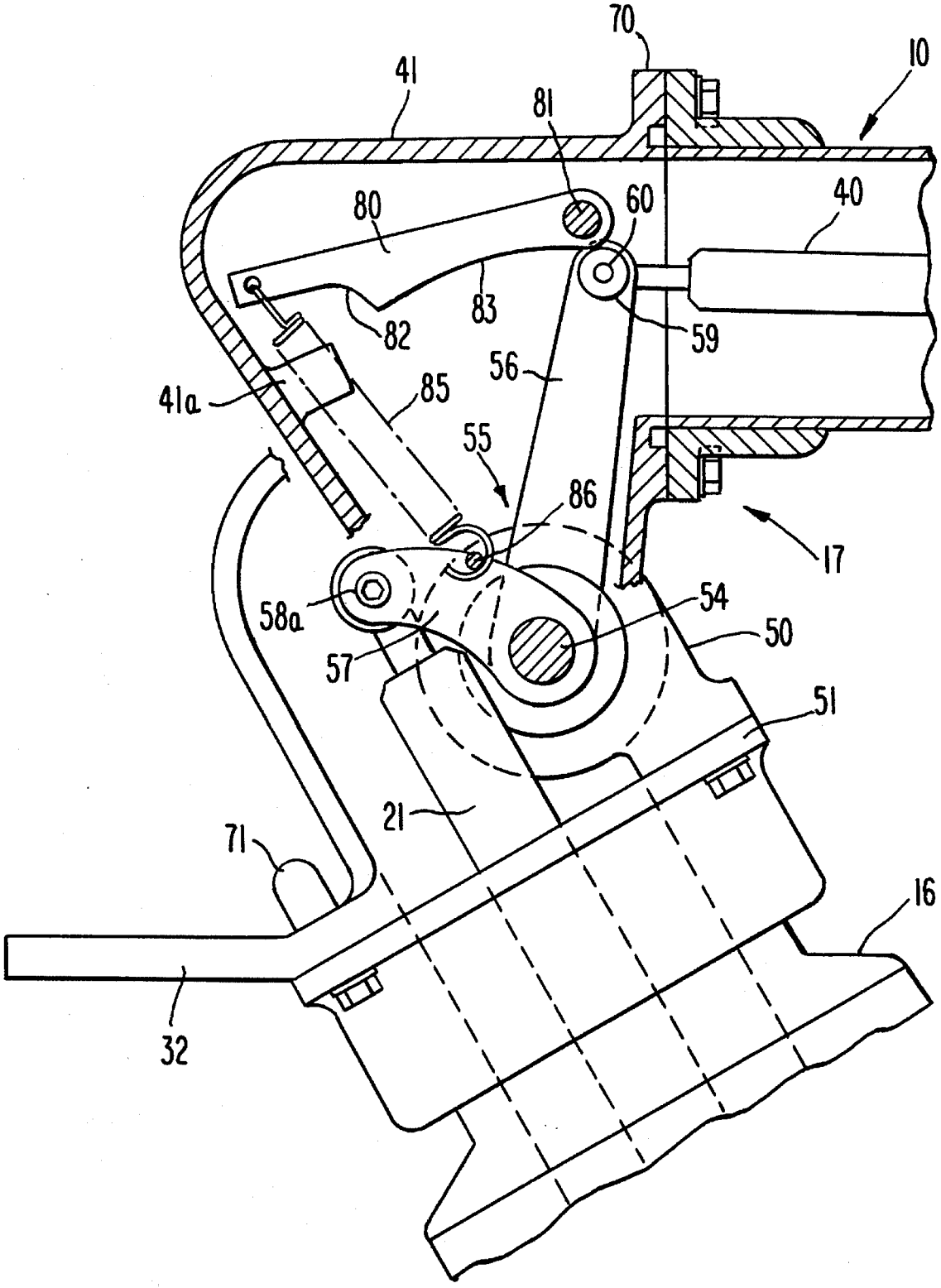
FIG. 4 is a view of the mechanism of FIG. 2 with both the disconnector and interrupter closed.
Figure 5:
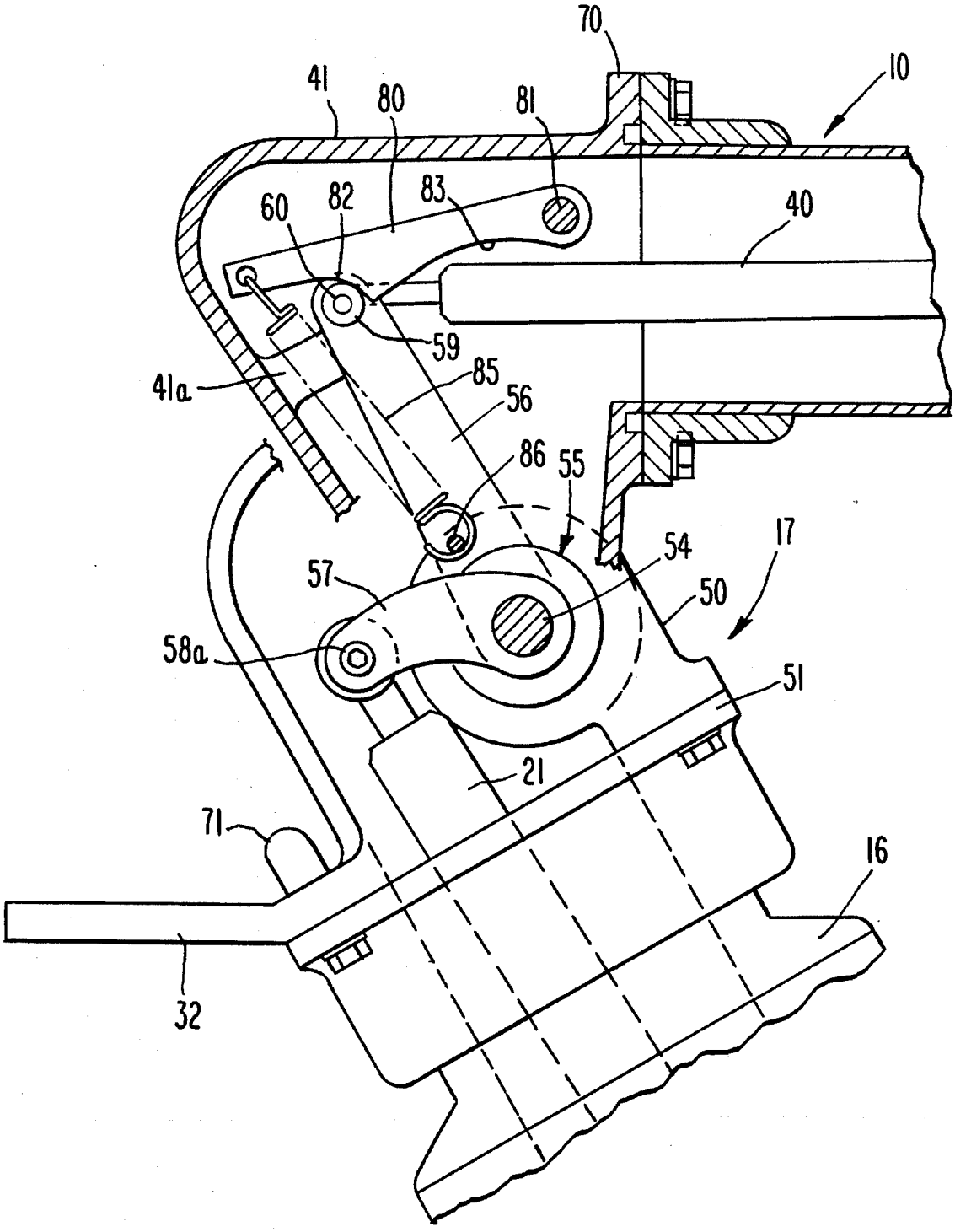
FIG. 5 is a view of the mechanism of FIG. 2 with the disconnector closed and the interrupter open.

As best shown in FIGS. 2, 4 and 5, the interrupter 10 is bolted to housing 41 at the bolt flange 70 of housing 41. Housing 41 is rotatable relative to housing 50 from the switch-open position of FIG. 2 to the switch-closed position of FIGS. 4 and 5. When open, the housing 41 sits against stop 71 on housing 50.

A latch lever 80 is pivotally mounted within housing 41 on pin 81 and has a main latch surface 82 and a second guide surface 83. A tension spring 85 has one end connected to one end of latch lever 80 and its other end is fixed to pin 86 on housing 41. Spring 85 has sufficient tension to firmly hold roller 59 in the latch surface 82 of latch lever 80 while the interrupter and disconnector blade are being rotated from the position of FIG. 1, but can be cammed out of the surface 82 after the disconnect blade 30 (FIG. 1) seats in jaw 15 and a rotational force is continued on crank 54. In that case, roller 59 of crank arm lever 56 releases from latch lever 80 and drives interrupter operating rod 40 independently of housing 41, which is fixed in the disconnect switch-closed position.

It is now possible to describe the operation of the novel linkage of FIGS. 2 through 5. Assume first that the disconnector 11 and interrupter 10 are both open and the linkages are in the position of FIG. 2. In order to close the system, rod 21 is pushed upwardly toward the position of FIG. 5. Initially, since latch roller 59 is latched in latch surface 82 under the tension of spring 85, the crank 55 will rotate the housing 41 and the interrupter housing 10 clockwise as a unit, causing the blade 30 to enter the jaw 15, thus closing the disconnector. As the crank 55 continues to rotate clockwise, and the housing 41 has moved to its end position of FIG. 5, the roller 59 cams out of surface 82, forcing latch lever 80 to rotate clockwise about its pivot 81. The continued clockwise rotation of crank 55 now drives operating rod 40 of interrupter 10 to the right, causing the closing of the contacts of interrupter 10. The system is now fully closed and in the position of FIG. 4.

In order to reopen the system, the operating mechanism first causes rod 21 to move downwardly, first from the position of FIG. 4, to the position of FIG. 5. This causes the counterclockwise motion of crank 55 and movement of the interrupter operating rod 40 to the left in FIG. 5, in order to first open the contacts of interrupter 10, interrupting the load current. The housing 41 remains in the position of FIG. 5 during this operation by the force of engagement between contact blade 30 and contact 15.

When the crank 55 reaches the position of FIG. 5, crank lever 56 engages stop 41*a* within housing 41. Roller 59 rides down surface 83 of latch arm 80, extending tension spring 85, until roller 59 re-latches in latch surface 82. Housing 41 begins to rotate counterclockwise with crank 55, thus rotating interrupter 10 and the disconnect blade counterclockwise from the position of FIGS. 1 and 5 to the fully open position of FIGS. 1*a* and 2. The counterclockwise motion of housing 41 stops when housing 41 reaches stop 71 of stationary housing 50. The switch system is now reclosed and mechanism 17 is in the position of FIG. 2, ready for a new operation.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An operating mechanism for operating a combined disconnector and interrupter wherein the interrupter is a component of the rotating contact arm of the disconnector and wherein the interrupter contains interrupter contacts operated by a linearly movable operating rod; said operating mechanism comprising, in combination:

an operating crank having a pivotal support axle, a crank arm and a crank lever; said crank lever having a free end, pivotally connected to said linearly movable operating rod;

a stationary support member pivotally receiving said pivotal support axle;

a rotatable support member pivotally mounted on said stationary support member and coaxial with said pivotal support axle; one end of said interrupter being fixed to said rotatable support member;

a latch lever pivotally mounted to said rotatable support member and having a latch surface and tension spring means for rotating said latch surface into latching engagement with said free end of said crank lever;

a crank lever stop fixed to said rotatable support member for engaging said crank lever after said crank arm has rotated through a first portion of its motion while moving said linearly movable operating rod to an open position;

a rotatable support member stop fixed to said stationary support member for engaging said rotatable support member after said crank arm has engaged said crank lever stop and has subsequently rotated through a second portion of its motion;

said latch lever being cammed to release said crank lever after said rotatable support member is rotated to a position at which said disconnector closes.

2. The device of claim 1 wherein said crank is connected to and operated by a linearly movable operating rod.

3. The device of claim 1 wherein said stationary and rotatable members are housings.

4. The device of claim 2 wherein said stationary and rotatable members are housings.

5. The device of claim 3 wherein said latch lever, crank lever and tension spring means are mounted within said rotatable housing.

6. The device of claim 3 wherein said crank and said pivotal support lever are mounted within said stationary housing.

7. The device of claim 1 wherein said tension spring means has one end connected to said latch lever and an opposite end connected to said operating crank.

8. The device of claim 2 wherein said tension spring means has one end connected to said latch lever and its opposite end connected to said operating crank.

9. The device of claim 5 wherein said crank and said pivotal support lever are mounted within said stationary housing.

10. The device of claim 9 wherein said tension spring means has one end connected to said latch lever and an opposite end connected to said housing.

* * * * *